US011077386B1

(12) United States Patent
Voisin

(10) Patent No.: US 11,077,386 B1
(45) Date of Patent: Aug. 3, 2021

(54) INTERLOCKING TOYS

(71) Applicant: ROYLCO, INC., Anderson, SC (US)

(72) Inventor: Carolyn Voisin, Anderson, SC (US)

(73) Assignee: ROYLCO, INC., Anderson, SC (US)

( * ) Notice: Subject to any disclaimer, the term of this patent is extended or adjusted under 35 U.S.C. 154(b) by 9 days.

(21) Appl. No.: 16/773,399

(22) Filed: Jan. 27, 2020

(51) Int. Cl.
*A63H 33/08* (2006.01)

(52) U.S. Cl.
CPC ..... *A63H 33/084* (2013.01)

(58) Field of Classification Search
CPC ..... A63H 33/06; A63H 33/08; A63H 33/084
See application file for complete search history.

(56) References Cited

U.S. PATENT DOCUMENTS 1,236,896 A * 8/1917 Anderson ..... A63H 33/084 446/82
2,800,743 A * 7/1957 Meehan ..... A63H 33/084 446/127
3,374,917 A * 3/1968 Troy ..... E04B 2/18 220/23.4
3,456,413 A * 7/1969 Fischer ..... A63H 33/084 52/591.1
4,109,409 A * 8/1978 Fischer ..... A63H 33/082 446/127
5,853,314 A * 12/1998 Bora ..... A63H 33/086 446/120
8,715,029 B2 * 5/2014 Bishop ..... A63H 33/084 446/85

* cited by examiner

*Primary Examiner* — John A Ricci
(74) *Attorney, Agent, or Firm* — Nelson Mullins Riley & Scarborough LLP

(57) ABSTRACT

The invention comprises a plurality of rectangular prism and/or cubic blocks. The sidewalls of the blocks comprise various combinations of grooves and/or pegs. Each groove extends along the respective sidewall within which it is disposed, from a corner wherein the top wall and the respective sidewall intersect to a corner wherein the bottom wall and the respective sidewall intersect. Each peg is configured to be slidably received into a groove disposed on another block within the plurality of blocks.

20 Claims, 10 Drawing Sheets

INTERLOCKING TOYS

FIELD OF THE INVENTION

The present invention relates generally to interlocking bricks, blocks and toys.

BACKGROUND

Typical toy building blocks have male and female features which allow the blocks to be snap-fit together to create various structures. As one example, Lego® bricks are predominantly square or rectangular blocks that can be snap-fitted in multiple layers to form different shapes and structures. Most Lego® bricks are six-sided blocks having one or more studs protruding from only one of the six sides. The Lego® bricks also typically include one or more receptacles only on the opposite side of the brick, relative to the studs, which are configured to receive the studs of mating bricks. Typically, the bricks do not have studs or receptacles on the remaining four sides of the brick. Thus, toy blocks of this type can be stacked, but only in limited arrangements. They must be snapped together, directly atop one another.

Through hard work and ingenuity, the present inventors have developed a developmental aid and toy brick set that has many more configurations than are possible with traditional Lego® bricks, for example. The inventive toy blocks are not only capable of stacking wherein one block is positioned directly atop another block, but also has configurations that interconnect on adjacent sidewalls. The inventive toy blocks have a slidable interconnection rather than a snap-fit connection. Thus, the inventive toy blocks, once connected, are more securely connected than snap-fit blocks. Additionally, due to the particular peg and groove design, the inventive toy blocks are rotatable against one another once connected. These and other advantages make the present invention not only a fun and creative toy, but also require the use and development of fine motors skills as well as providing a sliding and twisting fidget outlet for children and adults alike.

SUMMARY OF THE INVENTION

In one aspect, the invention comprises a plurality of rectangular prism blocks, each comprising a rectangular top wall; a rectangular bottom wall opposite the top wall; a first rectangular sidewall adjacent the top wall and bottom wall and comprising two grooves or two pegs; a second square sidewall adjacent the top wall, bottom wall, and first sidewall comprising a groove or a peg; a third rectangular sidewall adjacent the top wall, bottom wall, and second sidewall comprising two grooves or two pegs; a fourth square sidewall adjacent the top wall, bottom wall, third sidewall, and first sidewall comprising a groove or a peg; wherein each groove extends along the respective sidewall within which it is disposed, from a corner wherein the top wall and the respective sidewall intersect to a corner wherein the bottom wall and the respective sidewall intersect, and wherein each peg is configured to be slidably received into a groove disposed on another block within the plurality of blocks.

In another aspect, the top wall and bottom wall do not comprise a peg or groove. In one aspect, a peg on a first block is slidably received into a groove on a second block to form interconnected blocks, the sidewall of the first block wherein the peg is disposed and the sidewall of the second block wherein the groove is disposed are flush. The interconnected first and second blocks may be rotatable when the sidewalls are flush.

In an aspect, at least one of the top wall and the bottom wall comprise structural elements. In another aspect, a peg of a first block in the plurality of blocks cannot be snap-fit into a groove of a second block in the plurality of blocks.

In an embodiment, each of the grooves comprise a recess extending inwardly into the sidewall. In another embodiment, each of the pegs comprise a cylindrical neck portion extending perpendicularly from the sidewall and a head portion comprising an inner cylindrical portion and an outer half-spherical portion, wherein the inner cylindrical portion of the head has a greater diameter than the cylindrical neck portion. In an embodiment, each of the grooves comprise a narrow portion which is adapted to receive the neck portion of the peg and a bulbous portion which is adapted to receive the head portion of the peg. The peg may be rotatable about its axis within the groove.

In an aspect, the invention comprises a plurality of cubic blocks comprising: a top wall; a bottom wall opposite the top wall; a first sidewall adjacent the top wall and bottom wall; a second sidewall adjacent the top wall, bottom wall, and first sidewall; a third sidewall adjacent the top wall, bottom wall, and second sidewall; a fourth square sidewall adjacent the top wall, bottom wall, third sidewall, and first sidewall; wherein at least two of the sidewalls comprise: a groove which extends along the respective sidewall within which it is disposed, from a corner wherein the top wall and the respective sidewall intersect to a corner wherein the bottom wall and the respective sidewall intersect, or a peg which is configured to be slidably received into a groove disposed on another block within the plurality of blocks.

In one aspect, the first sidewall, second sidewall, third sidewall, and fourth sidewall each comprise a peg. In another aspect, the first sidewall, second sidewall, third sidewall, and fourth sidewall each comprise a groove. In still another aspect, the first sidewall comprises a peg and the third sidewall comprises a groove, and wherein the second sidewall and fourth sidewall do not comprise a groove or peg. In an aspect, the first sidewall comprises a peg, the second sidewall comprises a peg, the third sidewall comprises a groove, and the fourth sidewall comprises a groove.

BRIEF DESCRIPTION OF THE DRAWING(S)

Having thus described the disclosure in general terms, reference will now be made to the accompanying drawings, which are not necessarily drawn to scale, and wherein:

DETAILED DESCRIPTION

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

As shown in the figures, the inventive blocks may comprise a variety of shapes and configurations. For example, the blocks may have a square or rectangular cross-sectional configuration, in certain embodiments. In other embodiments, however, the blocks may have a triangular, pentagonal, circular, or any other cross-sectional configuration known in the art.

Figure 6:
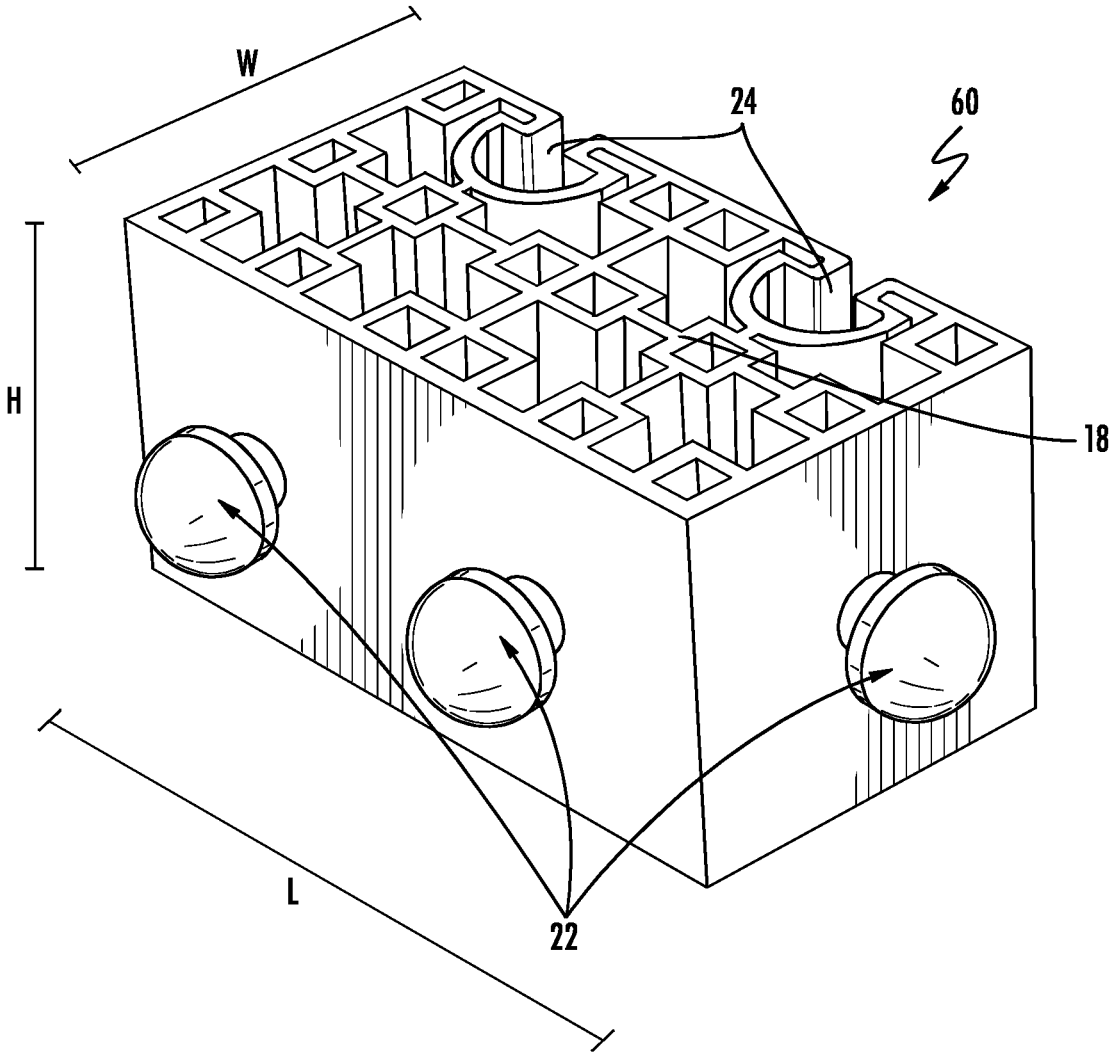
FIG. 6 illustrates a perspective view of a block in an embodiment of the present invention.

In an embodiment, a block of the present invention generally comprises a cube or a rectangular prism. The cube configuration may have a length, width, and height that are each equivalent. The rectangular prism configuration may have a length (L) that is larger than the width (W) and/or height (H) of the block (see FIG. 6). In some embodiments, the rectangular prism configuration may have a length (L) that is twice the width (W) and twice the height (H) of the block, wherein the width (W) and height (H) of the block are equivalent. In an embodiment, the width (W) and height (H) of the rectangular prism block are equivalent to the width (W) and height (H) of the cube configuration.

In an embodiment, each block of the present invention comprises six faces. In some embodiments, the faces comprise a top face 12, a bottom face 14, and four side faces 16. While the faces may be referred to herein as a top, bottom or side, it should be understood that any of the six faces of the block could comprise a top, bottom, or side face. Likewise, the top face and/or bottom face could be referred to as an end face.

In an embodiment, each block may comprise structural elements 18 which provide the block with rigidity and stability. In an embodiment, the structural elements 18 may comprise a repeating element. In a particular embodiment, the structural elements 18 may comprise repeating three-dimensional square or rectangular structures which are interconnected by one or more ribs 19. In an embodiment, the structural elements 18 may be visible on the bottom face 14 of the block. Likewise, in an embodiment, the structural elements 18 may be visible on the top face 12 of the block. In a particular embodiment, structural elements 18 are present on the bottom face 14 and the top face 12 of the block. In this embodiment, a middle wall 39 may be disposed between the bottom face 14 and the top face 12 of the block. The middle wall 39 may be solid, in an embodiment. The middle wall 39 may be disposed equidistance between the bottom face 14 and the top face 12 of the block, in an embodiment.

In an embodiment, looking at the bottom face 14 and/or the top face 12, each block may comprise a structural element 18 in each of the four corners (i.e. a corner structural element 18). Additionally, at least one structural element 18 may be disposed along each sidewall 16 between the corner structural elements 18 (a sidewall structural element 18). Further, a structural element 18 may be disposed in the center of the bottom face 14 (a center structural element 18). Each of the sidewall structural elements 18 may be interconnected to the center structural element 18 by one or more ribs 19. In the rectangular prism version of the blocks (see FIG. 7), a rib 19 may disposed in the lengthwise (L) center of the block, intersecting the length L. As shown, structural elements 18 may be disposed on each side of the central rib 19.

As noted, in an embodiment, the structural elements 18 are visible on the bottom face 14 and/or the top face 12 of the block and may extend internally within the block, from the bottom face 14 and/or the top face 12, through the interior of the block, to the interior surface of the opposing block face or to the middle wall 39, as the case may be.

In some cases, such as in the case of the structural elements 18 disposed against a sidewall 16, the structural elements 18 may extend internally within the block, from the bottom face 14 and/or the top face 12, through the interior of the block, adjacent the sidewall(s) 16, to the interior surface of the top face 12, the bottom face 14, or the middle wall 39, as the case may be. In an embodiment, the bottom face 14 and/or the top face 12 of the block is otherwise open to the interior of the block and/or does not comprise a solid surface. In some embodiments, the block 10 is otherwise hollow. In a particular embodiment, both the bottom face 14 and the top face 12 are hollow other than the structural elements 18 and one or more ribs 19.

In an embodiment, each block of the present invention comprises at least one peg 22 and/or at least one groove 24. In some embodiments, particular blocks of the present invention comprise a plurality of pegs 22 and/or a plurality of grooves 24. In an embodiment, each of the blocks comprises at least one peg 22 or at least one groove 24. In an embodiment, the pegs 22 and grooves 24 of the invention are disposed within the sidewalls 16 of the blocks. In this embodiment, the top face 12 and the bottom face 14 of each block are flat and the blocks can be positioned flatly and stably on a surface on the top face 12 or the bottom face 14 of the block for review, identification, and/or building purposes.

Each of the pegs 22 of each block may be identically shaped and sized, in some embodiments. In other embodiments, some pegs 22 may have different shapes or sizes than other pegs 22, such that the user may have to use logic and/or other skills to determine which pegs 22 correspond with which grooves 24.

Likewise, each of the grooves 24 of each block may be identically shaped and sized, in some embodiments. In other embodiments, grooves 24 may have different shapes or sizes than other grooves 24, such that the user may have to use logic and/or other skills to determine which grooves 24 correspond with which pegs 22.

In an embodiment, the pegs 22 and grooves 24 are formed during the formation of the block itself. In an embodiment, any peg 22 corresponds to and can be used in any groove 24. In an embodiment, the pegs 22 each have a neck portion 26 and a head portion 28. In an embodiment, the neck portion 26 is affixed to or is integral with a sidewall 16 or top wall 12 of the block. In an embodiment, the neck portion 26 extends outwardly from the wall of the block, in a direction which is perpendicular to the direction of the sidewall to which it is affixed or integral with.

In an embodiment, the neck portion 26 is cylindrical, but any shape may be utilized herein. For example, the neck portion 26 could have an ovular, triangular, rectangular, or other cross section. Likewise, the neck portion 26, in an embodiment, may be solid, but in other embodiments, may be hollow. In an embodiment, the neck portion 26 may be shaped as a partial cylinder, wherein the cylindrical sidewall of the neck portion 26 is not continuous. In an embodiment, the neck portion 26 is narrower than that of the head portion 28. That is, the diameter of the neck portion 26 is less than that of the head portion 28.

In an embodiment, the head portion 28, like the neck portion 26, extends outwardly from the sidewall of the block to which it is affixed. In an embodiment, the head portion 28 of the peg 22 is convex. In an embodiment, the head portion 28 of the peg 22 may be bulbous in shape and configuration. The head portion 28 may be half-spherical or mushroom-shaped. In an embodiment, the head portion 28 comprises a half-spherical outer portion 29 and a cylindrical inner portion 27 (see FIG. 8). In this embodiment, the inner portion 27 of the head 28 connects to the neck portion 26. In an embodiment, the diameter and circumference of the inner portion 27 are greater than the diameter and circumference of the neck portion 26, respectively. The transition from the inner portion 27 to the outer portion 29 may be smooth, allowing for ease of movement of the pegs 22 within the grooves 24.

In an embodiment, the grooves 24 may comprise hollowed-out or recessed portions of the block. The grooves 24 may extend inwardly into the interior space of the block. In an embodiment, the grooves 24 are disposed in the sidewalls 16 of the blocks. In one embodiment, the grooves 24 may be disposed in the top wall 12 of the block. In an embodiment, the grooves 24 are longitudinal and extend centrally along the sidewall 16 of the block.

Figure 4:
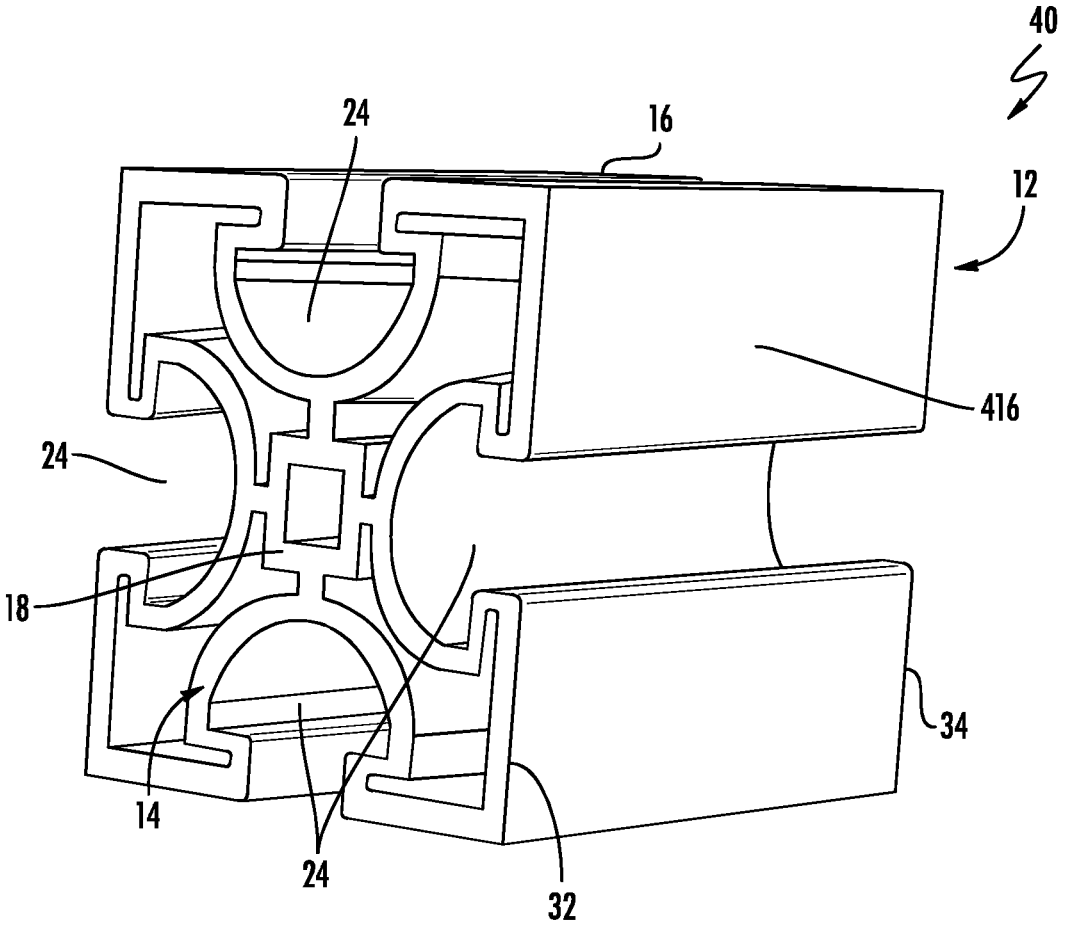
FIG. 4 illustrates a perspective view of a block in an embodiment of the present invention.
Figure 5:
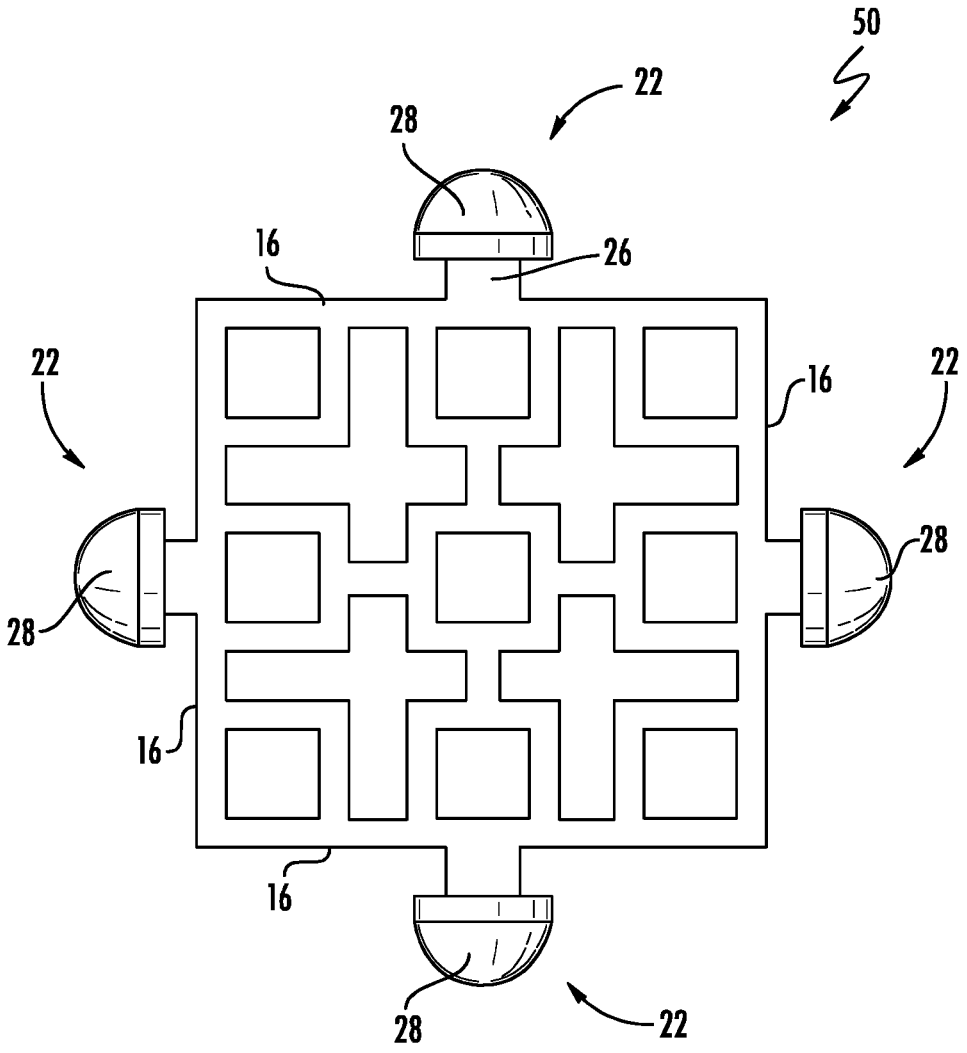
FIG. 5 illustrates a top view of a block in an embodiment of the present invention.

In an embodiment, the grooves 24 begin at one corner of the block (the location where two block walls are adjoined) and extend through a sidewall 16 to the opposite corner. For example, as shown in FIG. 4, the groove 24 begins at corner 32, the corner between the sidewall 416 and the bottom face 14, and extends through sidewall 416 to corner 34, between sidewall 416 and the top face 12. In an embodiment, the groove 24 is shaped and sized the same across the sidewall 16, between the corners 32, 34. That is, there is no variation in the width, depth, or other dimension between one end of the sidewall 16 and the other.

In an embodiment, the grooves 24 have a similar shape or the same shape, but inverse, to that of the pegs 22. That is, the grooves 24 may comprise a narrow portion 31 and a bulbous portion 33. The narrow portion 31 may be disposed to receive the neck 26 of the peg 22. In an embodiment, the narrow portion 31 is sized slightly larger than that of the neck portion 26 of the peg, such that the neck portion 26 may slide through the narrow portion 31 of the groove 24.

Figure 8:
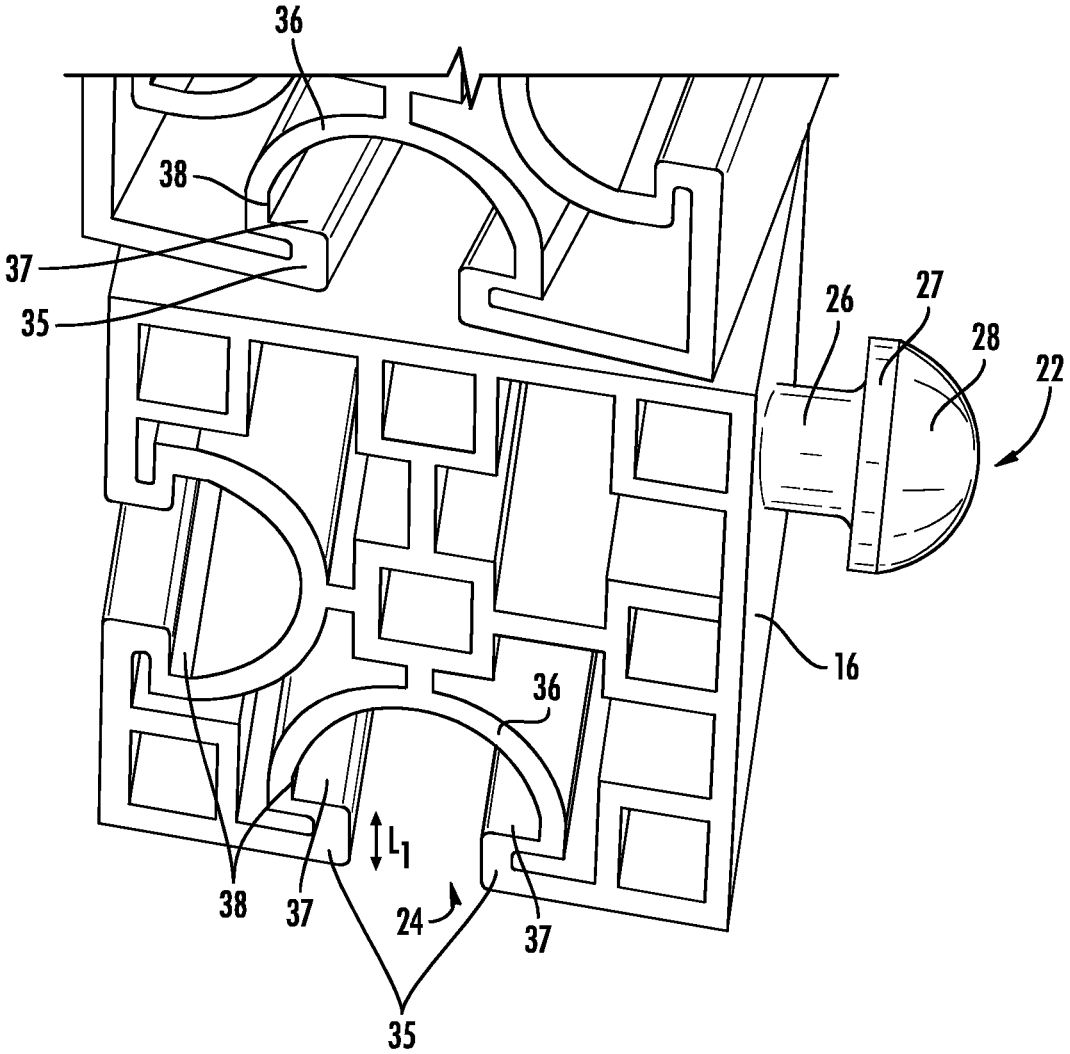
FIG. 8 illustrates a perspective view of two connected blocks in an embodiment of the present invention.

In an embodiment, the narrow portion 31 comprises two walls 35 which are perpendicular to the sidewall 16 or top wall 12 from which it extends inwardly (see FIG. 8). The perpendicular wall 35 of the groove 24 may have a length (Li) which corresponds to the length of the neck portion 26 of the peg 22. The sidewall 16 or top wall 12 within which the groove 24 is disposed follows the shape of the groove 24. That is, there is a discontinuity between the perpendicular walls 35 of the groove 24.

The bulbous portion 33 of the groove 24 may be disposed to receive the head 28 of the peg 22. In an embodiment, the bulbous portion 33 of the groove 24 is sized slightly larger than that of the head portion 28 of the peg 22, such that the head portion 28 may slide through the bulbous portion 33 of the groove 24. In an embodiment, the bulbous portion 33 of the groove 24 is concave.

In an embodiment, like the head portion 28 of the peg 22, the bulbous portion 33 of the groove 24 may be half-spherical or mushroom-shaped. In an embodiment, the bulbous portion 33 comprises a half-spherical inner portion 36 and a substantially perpendicular portion 38, wherein the substantially perpendicular portion 28 is perpendicular or substantially perpendicular to the sidewall 16 or top wall 12 from which it extends (see FIG. 8). In this embodiment, the wall 35 of the narrow portion 31 transitions from being perpendicular to the sidewall 16 to being parallel or substantially parallel to the sidewall 16, forming parallel wall 37. Parallel wall 37 then transitions into substantially perpendicular or perpendicular wall 38, which then transitions into half-spherical wall 36. These transitions repeat on the opposite side of the half-spherical wall 36.

In an embodiment, the peg 22 is conformed to slide into the groove 24, starting from any intersection of two walls containing a groove 24. The head 28 of the peg 22 may be inserted into the bulbous portion 33 of the groove 24 while the neck 26 is inserted into the narrow portion 31 of the groove 24. The fit may be slidably secure. That is, the peg 22 may slide right to left or left to right, top to bottom or bottom to top, respective of the configuration of the block.

In an embodiment, the peg 22 cannot be press-fit or snap-fit into or out of the groove 24. In this embodiment, the head 28 of the peg 22 is too great to fit between the narrow portions 31 of the groove 24. In an embodiment, the peg 22 cannot be inserted into or pulled out of the groove 24 in a direction which is 90 degrees (or roughly 90 degrees) from the wall within which the groove 24 is disposed.

Figure 1:
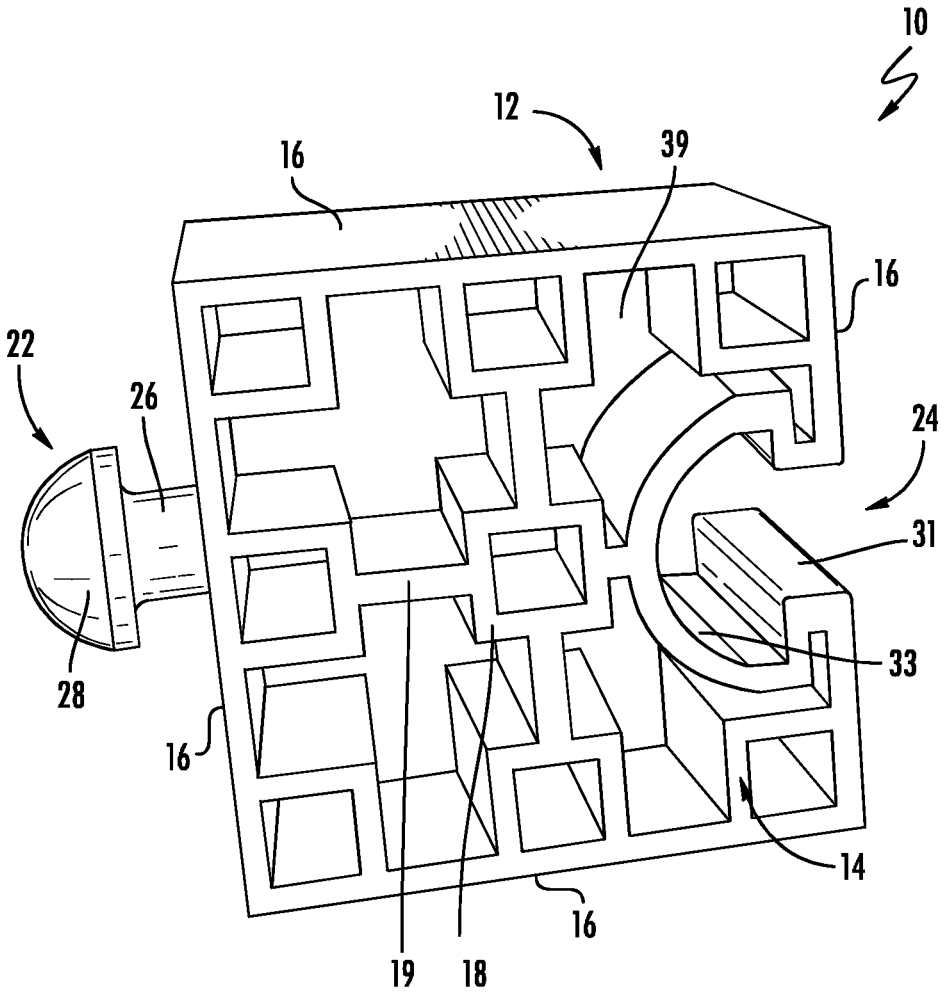
FIG. 1 illustrates a perspective view of a block in an embodiment of the present invention.
Figure 2:
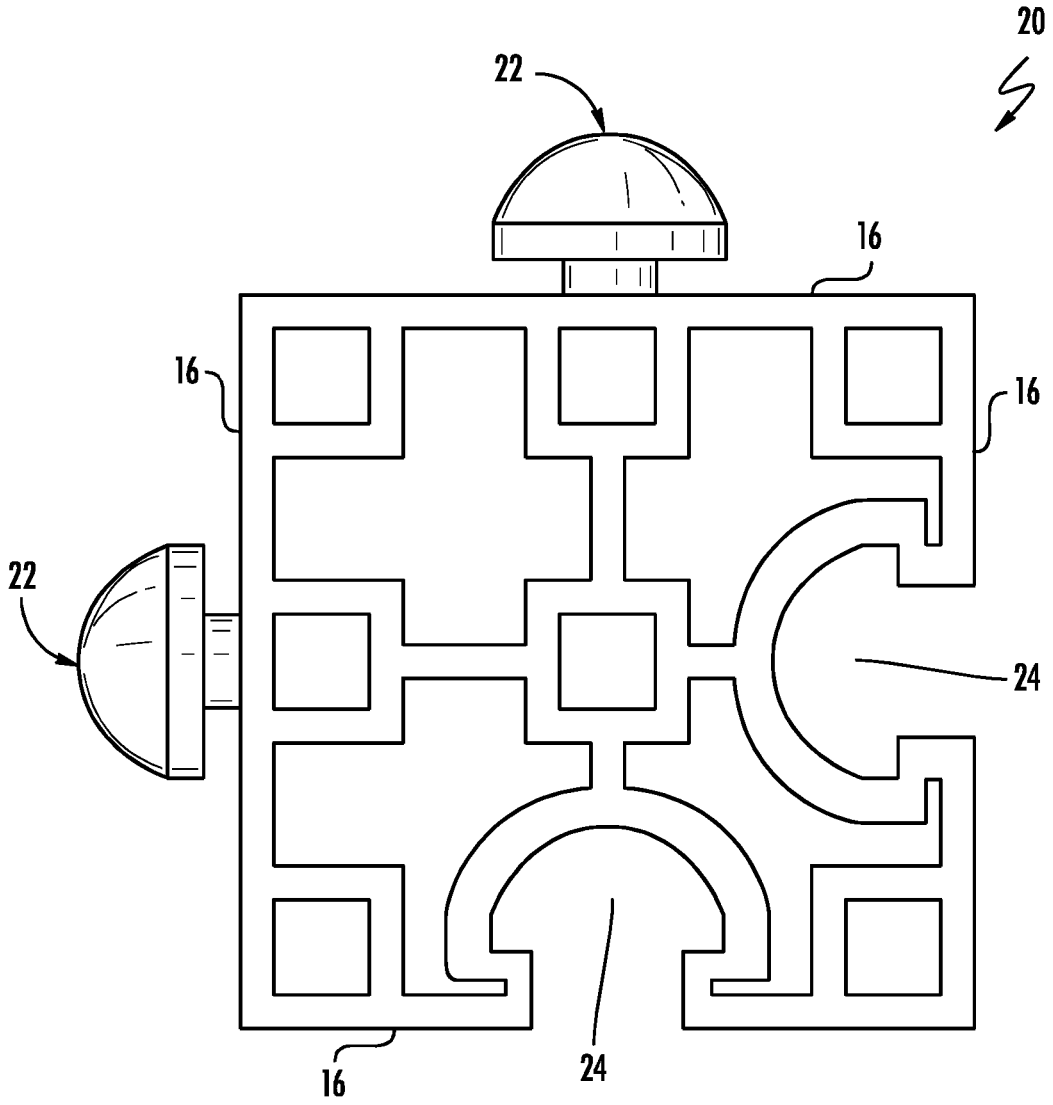
FIG. 2 illustrates a bottom view of a block in an embodiment of the present invention.
Figure 3:
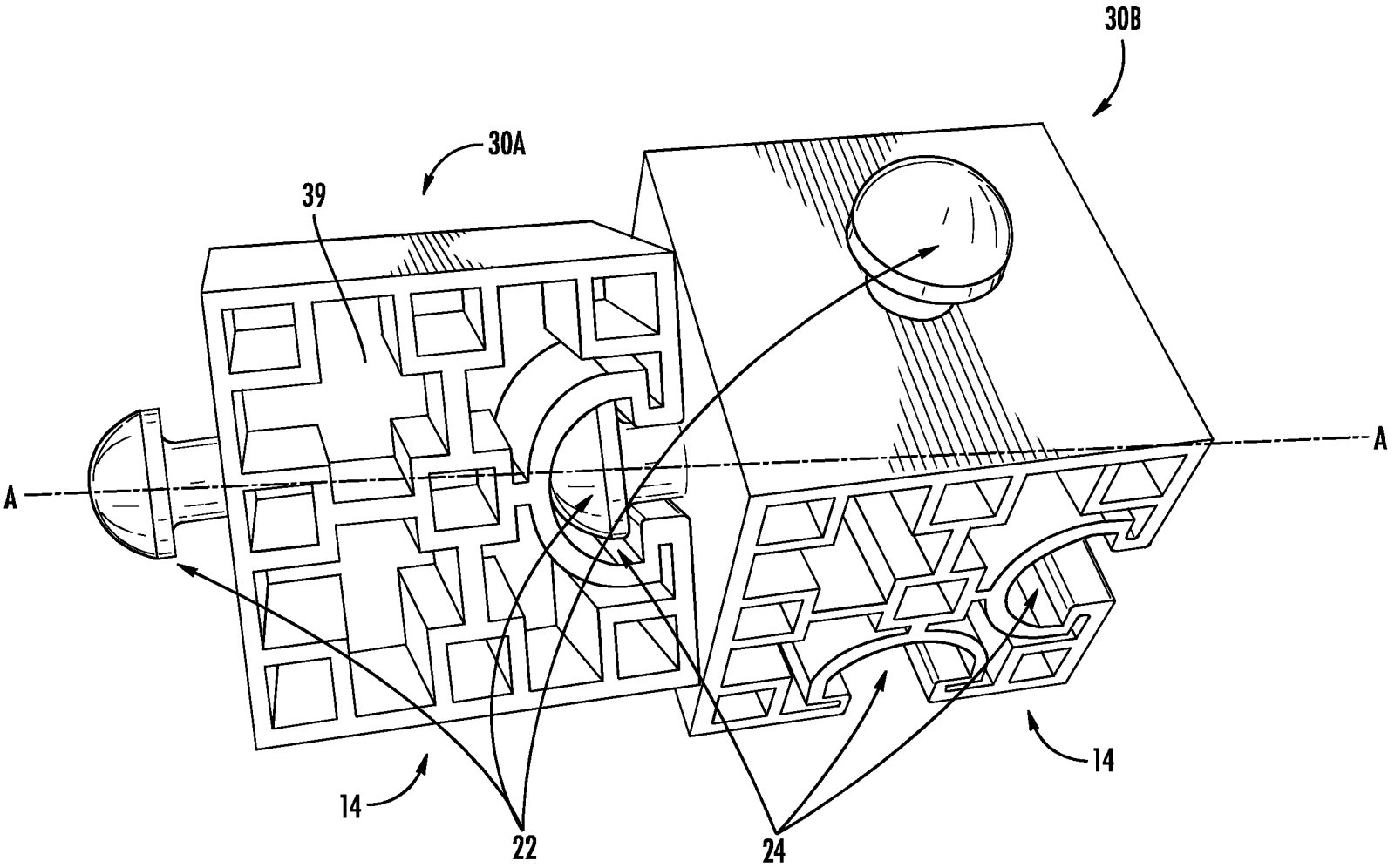
FIG. 3 illustrates a perspective view of two connected blocks in an embodiment of the present invention.

Due to the configuration of the peg 22 and groove 24 of the invention, once a peg 22 is inserted into a groove 24, one block may be twisted and/or rotated respective to its adjoining block. This is shown in FIGS. 3 and 8. In FIG. 3, the bottom face 14 of block 30A is shown. Block 30B is shown twisted against block 30A such that the bottom face 14 of block 30B is tilted slightly downwardly. Either or both blocks may continue to be twisted in either direction about an axis A which is disposed through the peg 22 which is interlocked within the groove 24. In an embodiment, each of two interlocked blocks may each be rotated between 0° and 360°, respectively. Likewise, if a plurality of blocks are interlocked, some or all of the blocks may be rotated against adjacent blocks.

In an embodiment, a rectangular prism block may comprise two grooves 24 and/or two pegs 22 centered along the long sidewall of the block. The grooves 24 and/or two pegs 22 may be disposed equidistance from each other, the midsection of the block, and/or the corners of the block.

Figure 7:
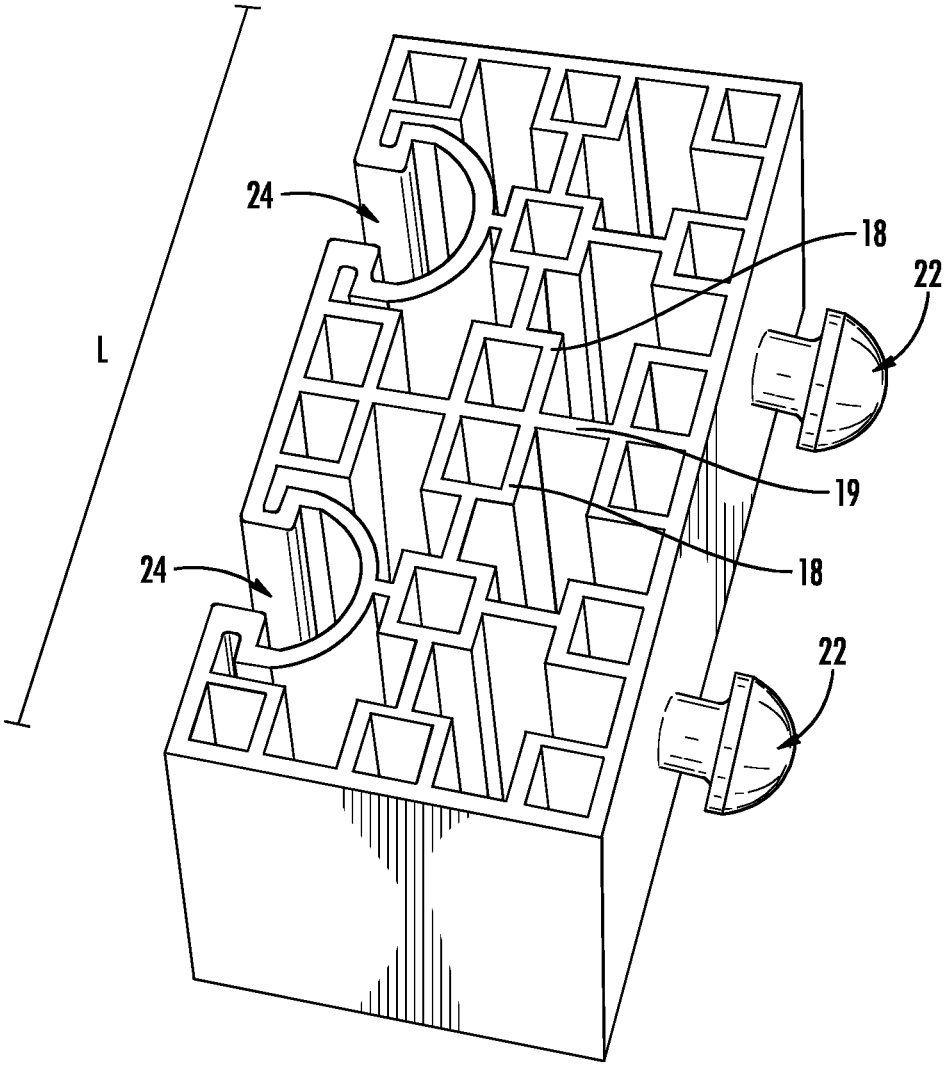
FIG. 7 illustrates a perspective view of a block in an embodiment of the present invention.

In an embodiment, grooves 24 interrupt certain structural features 18. Said alternatively, a groove 24 may replace one or more structural features 18. For example, FIG. 7 illustrates a rectangular prism wherein two grooves 24 are disposed along one of the longer sidewalls. The structural features 18 are shown throughout the top and/or bottom wall, but no structural feature is located in the position of the grooves 24.

Figure 9A:
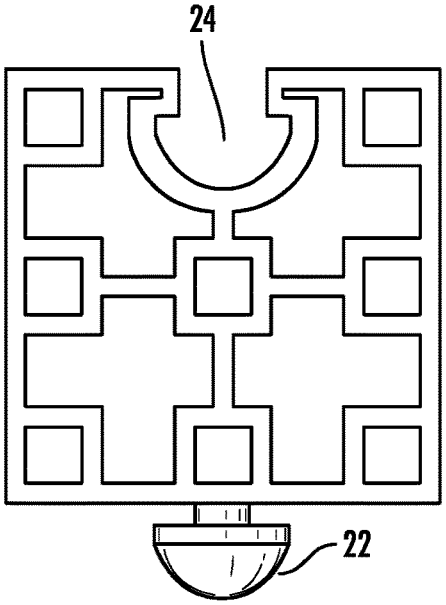
FIGS. 9A-9H illustrate top views of blocks in an embodiment of the present invention.
Figure 9B:
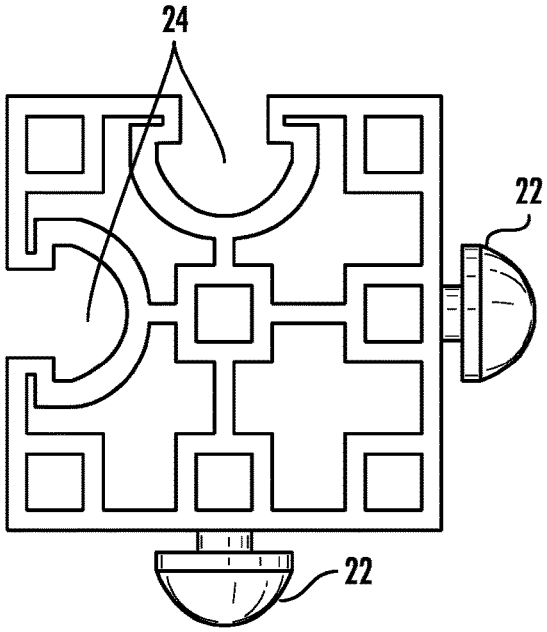
Figure 9C:
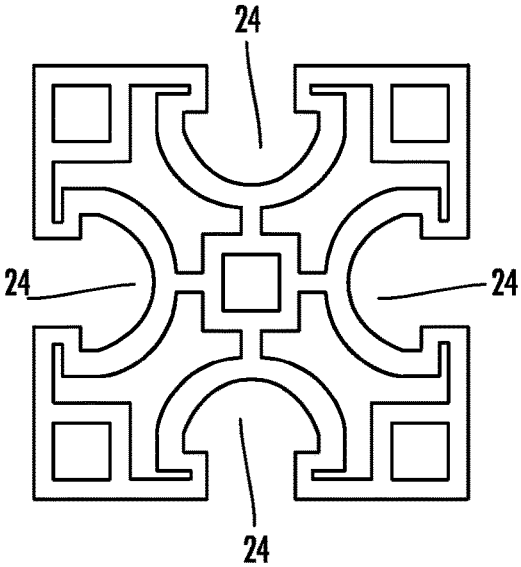
Figure 9D:
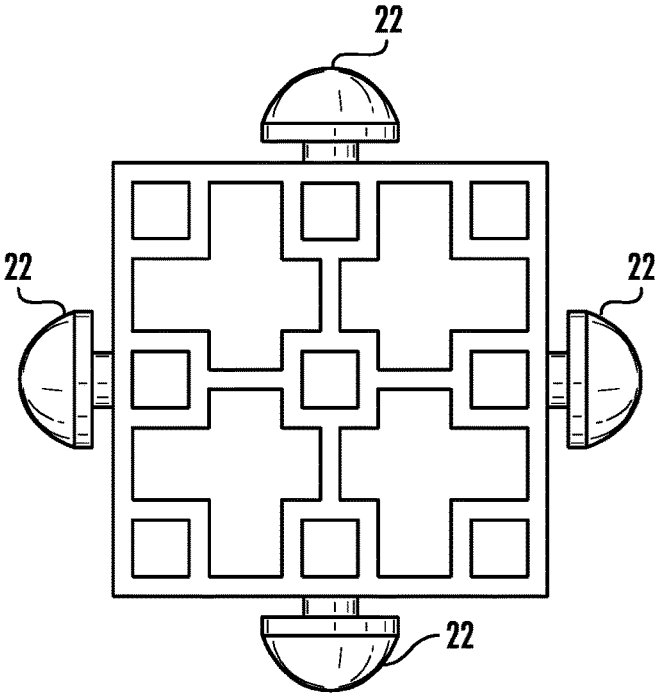

In an embodiment, a cubic block may comprise nine structural features 18 in an embodiment having no grooves (see FIG. 9D). Each groove 24 may replace one structural feature 18, such that a cubic block with one groove 24 may comprise eight structural features (FIG. 9A) and a cubic block with two grooves 24 may comprise seven structural features. Likewise, a cubic block with four grooves 24 may comprise only one central structural feature 18 (FIG. 9C).

Figure 9E:
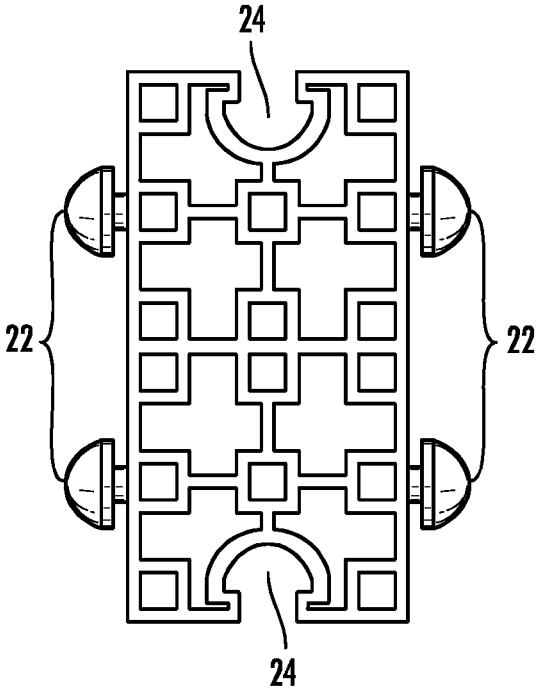
Figure 9F:
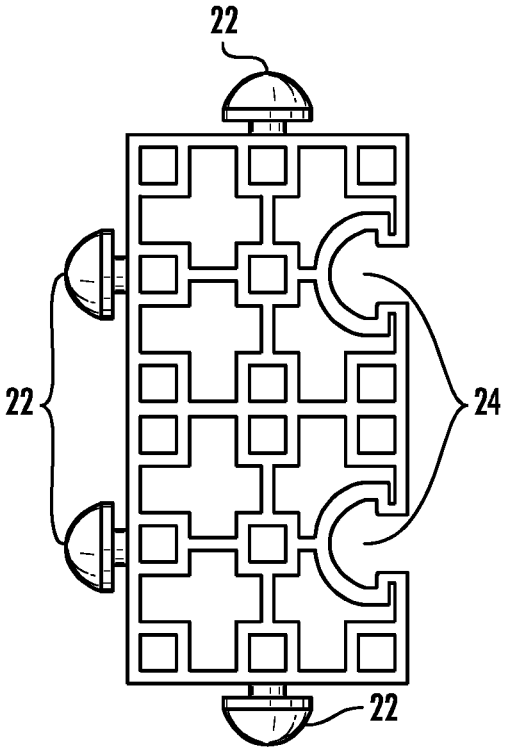
Figure 9G:
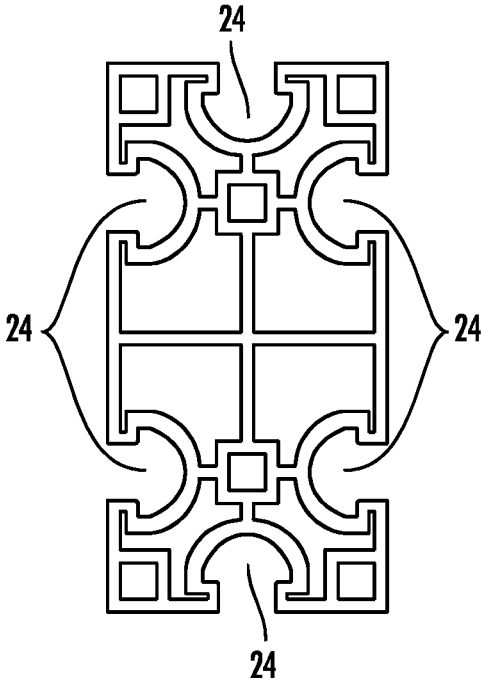
Figure 9H:
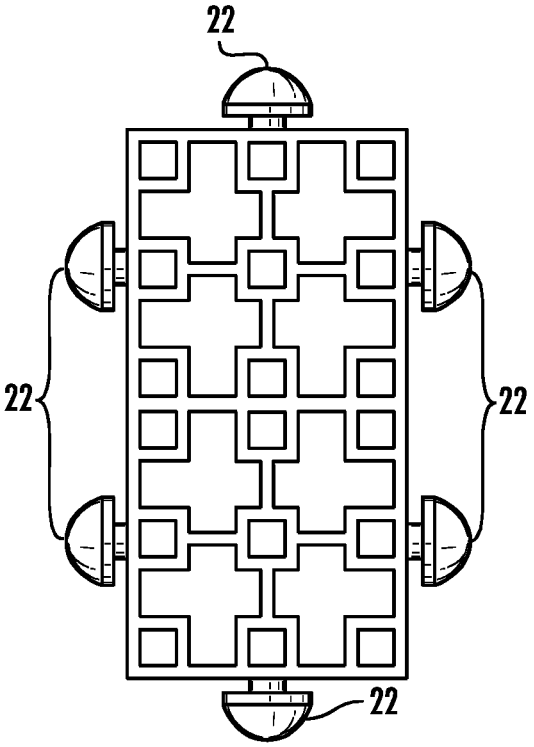

In another embodiment, a rectangular prism block may comprise eighteen structural features 18 in an embodiment having no grooves (see FIG. 9H). Each groove 24 may replace one structural feature 18, such that a rectangular prism block with two grooves 24 may comprise sixteen structural features (FIG. 9E, 9F) and a rectangular prism block with six grooves 24 may comprise only two structural feature 18 (FIG. 9G).

In an embodiment, the invention comprises a kit having a variety of block shapes and configurations. For example, the kit may comprise cubic blocks having the following configurations, each with front and back faces being flat with only structural features disposed therein (shown in FIG. 9): (A) one groove in a first sidewall, one peg in a second sidewall opposite the groove (B) a groove in each of two adjacent sidewalls, pegs in the remaining two adjacent sidewalls (C) four grooves, no pegs (D) four pegs, no grooves. The kit may additionally comprise rectangular prism blocks which each have two sidewalls which are short and two sidewalls which are long (i.e. thereby forming a rectangular prism). The rectangular prism blocks may have the following configurations, each with front and back faces being flat with only structural features disposed therein (shown in FIG. 9): (E) two grooves on opposite short sidewalls, four pegs on opposite long sidewalls; (F) two adjacent grooves on one long sidewall, two adjacent pegs on the opposite long sidewall and one peg on each of the short sidewalls; (G) six grooves, two on each long sidewall and one on each short sidewall, and having no pegs; and (H) six pegs, two on each long sidewall and one on each short sidewall, and having no grooves. In an embodiment, the views shown in FIG. 9 represent top views and the bottom views are the same as the top views.

In an embodiment, one block may connect to another block in multiple configurations (i.e. one peg may be inserted into several optional grooves). In addition, in the rectangular prism blocks, two pegs of one block may be inserted into two grooves of an adjacent block simultaneously. The number of possible connections between the various pegs and grooves are voluminous.

In an embodiment, the length, width, and depth of the cubic block may be approximately one inch. In an embodiment, the rectangular prism blocks may comprise a top wall, bottom wall, and two sidewalls that are approximately two inches in length and two sidewalls that are approximately one inch in length. Any size of the blocks is contemplated herein, however.

In an embodiment, the blocks may comprise different colors. In an embodiment, the color of the block corresponds to the shape or configuration of the block. For example, all blue blocks may be cubes with four pegs disposed on each of the four side faces. As another nonlimiting example, all red blocks may be rectangular prisms with two pegs on one sidewall and two grooves on the opposite sidewall.

In an embodiment, the blocks of the present invention comprise a rigid plastomeric material. In an embodiment, the material of the blocks may have some flexibility. However, the blocks should have a sufficient stiffness such that the pegs cannot be snap-fit into or out of the grooves and may only be inserted into or removed from the grooves slidably. The blocks of the invention may be thermoformed, injection molded, extrusion blow molded, vacuum formed, compression molded, three-dimensionally printed, or formed using any other methods known in the art.

In use, in an embodiment, two blocks may be selected among the various options. The peg of the first block may be inserted into the groove of the second block. The peg may slide into the groove such that the sidewall of the first block is flush against the sidewall of the second block. The peg may slide within the groove, maintaining the flush arrangement. Likewise, the peg may rotate within the groove, allowing rotation of the blocks while maintaining the flush sidewall arrangement. In an embodiment, a third block may then be selected and a peg of the third block may be inserted into a groove of the first or second block. Additional blocks may be added in a similar manner. The user may create various structures using a plurality of the blocks and/or may use the interconnected blocks as fidget toys. In certain embodiments, the structures created using the blocks are moveable—i.e. a robot may be created which has movable arms. In an embodiment, the kit of blocks comprises an instruction manual which provides directions on certain blocks to select and interconnect to form certain structures.

The accompanying figures are provided for explanatory purposes and may not show all components described herein with respect to embodiments of the dispenser. In addition, those components that are illustrated are not necessarily drawn to scale. Thus, certain layers that are shown as the same thickness or thinner than other layers may actually be thicker than other layers, and so on.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A plurality of rectangular prism blocks, each comprising:

a rectangular top wall;

a rectangular bottom wall opposite the top wall;

a first rectangular sidewall adjacent the top wall and bottom wall and comprising two grooves or two pegs;

a second square sidewall adjacent the top wall, bottom wall, and first sidewall comprising a groove or a peg;

a third rectangular sidewall adjacent the top wall, bottom wall, and second sidewall comprising two grooves or two pegs;

a fourth square sidewall adjacent the top wall, bottom wall, third sidewall, and first sidewall comprising a groove or a peg;

wherein each groove extends along the respective sidewall within which it is disposed, from a corner wherein the top wall and the respective sidewall intersect to a corner wherein the bottom wall and the respective sidewall intersect, and wherein each peg is configured to be slidably received into a groove disposed on another block within the plurality of blocks.

2. The plurality of rectangular prism blocks of claim 1 wherein the top wall and bottom wall do not comprise a peg or groove.

3. The plurality of rectangular prism blocks of claim 1 wherein when a peg on a first block is slidably received into a groove on a second block to form interconnected blocks, the sidewall of the first block wherein the peg is disposed and the sidewall of the second block wherein the groove is disposed are flush.

4. The plurality of rectangular prism blocks of claim 3 wherein the interconnected first and second blocks are rotatable when the sidewalls are flush.

5. The plurality of rectangular prism blocks of claim 1 wherein at least one of the top wall and the bottom wall comprise structural elements.

6. The plurality of rectangular prism blocks of claim 1 wherein a peg of a first block in the plurality of blocks cannot be snap-fit into a groove of a second block in the plurality of blocks.

7. The plurality of rectangular prism blocks of claim 1 wherein each of the grooves comprise a recess extending inwardly into the sidewall.

8. The plurality of rectangular prism blocks of claim 1 wherein each of the pegs comprise a cylindrical neck portion extending perpendicularly from the sidewall and a head portion comprising an inner cylindrical portion and an outer half-spherical portion, wherein the inner cylindrical portion of the head has a greater diameter than the cylindrical neck portion.

9. The plurality of rectangular prism blocks of claim 8 wherein each of the grooves comprise a narrow portion which is adapted to receive the neck portion of the peg and a bulbous portion which is adapted to receive the head portion of the peg.

10. The plurality of rectangular prism blocks of claim 9 wherein the peg is rotatable about its axis within the groove.

11. A plurality of cubic blocks comprising:

a top wall;

a bottom wall opposite the top wall;

a first sidewall adjacent the top wall and bottom wall;

a second sidewall adjacent the top wall, bottom wall, and first sidewall;

a third sidewall adjacent the top wall, bottom wall, and second sidewall;

a fourth square sidewall adjacent the top wall, bottom wall, third sidewall, and first sidewall;

wherein at least two of the sidewalls comprise:

a groove which extends along the respective sidewall within which it is disposed, from a corner wherein the top wall and the respective sidewall intersect to a corner wherein the bottom wall and the respective sidewall intersect, or a peg which is configured to be slidably received into a groove disposed on another block within the plurality of blocks.

12. The plurality of plurality of cubic blocks of claim 11 wherein the first sidewall, second sidewall, third sidewall, and fourth sidewall each comprise a peg.

13. The plurality of plurality of cubic blocks of claim 11 wherein the first sidewall, second sidewall, third sidewall, and fourth sidewall each comprise a groove.

14. The plurality of plurality of cubic blocks of claim 11 wherein the first sidewall comprises a peg and the third sidewall comprises a groove, and wherein the second sidewall and fourth sidewall do not comprise a groove or peg.

15. The plurality of plurality of cubic blocks of claim 11 wherein the first sidewall comprises a peg, the second sidewall comprises a peg, the third sidewall comprises a groove, and the fourth sidewall comprises a groove.

16. The plurality of plurality of cubic blocks of claim 11 wherein when a peg on a first block is slidably received into a groove on a second block to form interconnected blocks, the sidewall of the first block wherein the peg is disposed and the sidewall of the second block wherein the groove is disposed are flush.

17. The plurality of cubic blocks of claim 11 wherein each of the grooves comprise a recess extending inwardly into the sidewall.

18. The plurality of cubic blocks of claim 11 wherein each of the pegs comprise a cylindrical neck portion extending perpendicularly from the sidewall and a head portion comprising an inner cylindrical portion and an outer half-spherical portion, wherein the inner cylindrical portion of the head has a greater diameter than the cylindrical neck portion.

19. The plurality of cubic blocks of claim 18 wherein each of the grooves comprise a narrow portion which is adapted to receive the neck portion of the peg and a bulbous portion which is adapted to receive the head portion of the peg.

20. The plurality of cubic blocks of claim 19 wherein the peg is rotatable about its axis within the groove.

* * * * *